US007659704B2

(12) United States Patent
Shikata

(10) Patent No.: US 7,659,704 B2
(45) **Date of Patent: *Feb. 9, 2010**

(54) REGULATOR CIRCUIT

(75) Inventor: Eiji Shikata, Sendai (JP)

(73) Assignee: Freescale Semiconductor, Inc., Austin, TX (US)

( * ) Notice: Subject to any disclaimer, the term of this patent is extended or adjusted under 35 U.S.C. 154(b) by 261 days.

This patent is subject to a terminal disclaimer.

(21) Appl. No.: 12/022,160

(22) Filed: Jan. 30, 2008

(65) Prior Publication Data

US 2008/0191671 A1 Aug. 14, 2008

(51) Int. Cl.
*G05F 1/40* (2006.01)

(52) U.S. Cl. ..... 323/273

(58) Field of Classification Search ..... 323/273, 323/274, 280, 282, 283, 284, 351
See application file for complete search history.

(56) References Cited

U.S. PATENT DOCUMENTS

| | | | | |
|---|---|---|---|---|
| 7,095,220 | B2 * | 8/2006 | Kernahan | 323/300 |
| 7,109,691 | B2 * | 9/2006 | Brooks et al. | 323/282 |
| 7,157,889 | B2 * | 1/2007 | Kernahan et al. | 323/268 |

FOREIGN PATENT DOCUMENTS

| | | | |
|---|---|---|---|
| JP | 5011872 | A | 1/1993 |
| JP | 2004146548 | A | 5/2004 |

* cited by examiner

*Primary Examiner*—Adolf Berhane
(74) *Attorney, Agent, or Firm*—Charles Bergere

(57) ABSTRACT

A regulator circuit for efficiently and accurately outputting a target voltage with a simple circuit configuration. The regulator circuit includes an output circuit, a comparator, a counter block, a latch block, and a decoder block. When the target voltage is applied to an output terminal of the output circuit, the output circuit supplies the comparator with feedback voltage. Further, the feedback signal is provided to the counter block. The counter block performs counting in correspondence with the feedback signal. The latch block holds the signal acquired from the counter block and provides the held signal to the decoder block. The decoder block supplies the comparator with reference voltage. The comparator compares the reference voltage and the feedback voltage and controls the counting.

11 Claims, 6 Drawing Sheets

FIG. 6A
FIG. 6B
FIG. 6C
FIG. 6D
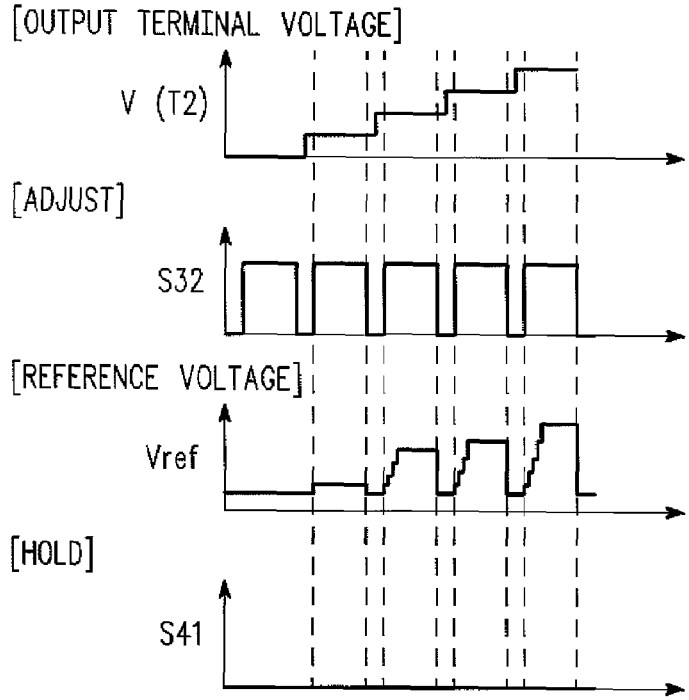
FIG. 7A
FIG. 7B
FIG. 7C
FIG. 7D
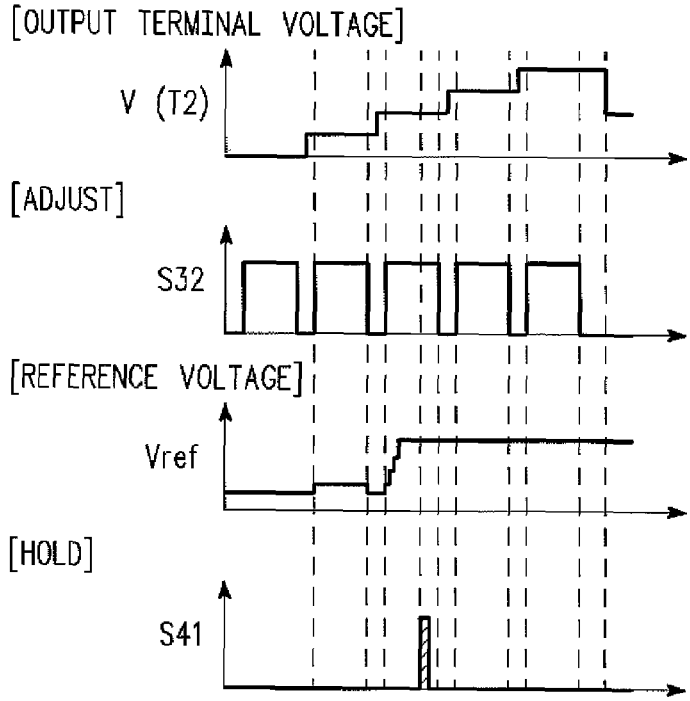

REGULATOR CIRCUIT

BACKGROUND OF THE INVENTION

The present invention relates to a regulator circuit enabling efficient acquisition of a desired voltage.

A regulator is used in a semiconductor device to acquire the desired voltage. In such a case, trimming may be performed to acquire the optimal output voltage (for example, refer to Japanese Laid-Open Patent Publication No. 2004-146548, page 1). The semiconductor device described in Japanese Laid-Open Patent Publication No. 2004-146548 includes an oscillation circuit and a voltage regulator, which is a constant voltage power supply enabling adjustment of the output voltage. During adjustment of the regulator's output voltage, a first power ON clear unit outputs a signal, which is determined by a time constant, when the regulator is activated. Further, a second power ON clear unit outputs a signal from when the regulator is activated to when adjustment of the output voltage ends. A reference voltage generation circuit generates a reference voltage based on the outputs of the power ON clear units. A voltage comparison circuit compares the output of the reference voltage generation circuit with the output of the regulator. The semiconductor device includes a counter for counting clock outputs of a clock control circuit. A decoder decodes the output of the counter and adjusts the output of the regulator.

The semiconductor device described in Japanese Laid-Open Patent Publication No. 2004-146548 requires accurate trimming to be performed for the output of a target voltage. More specifically, accurate calculations that take circuit resistance into account must be performed. When the calculations are inaccurate, the target voltage cannot be accurately acquired.

Japanese Laid-Open Patent Publication 5-11872 (page 1) describes a technique that would require scale enlargement or an increase in feedback resistance for accurate acquisition of the reference voltage. This may result in the circuit configuration being large or complicated. Further, the offset produced by a voltage comparison circuit may offset the output voltage.

Also, in this circuit configuration, a power reduction in the power supply that drives the regulator would erase the output setting of the counter. Thus, readjustments must be performed whenever a power reduction occurs.

Additionally, the adjustable voltage range is restricted by voltages (VDD, VSS) that are used to generate the reference voltage. Therefore, there is not much freedom for voltage setting.

BRIEF DESCRIPTION OF THE DRAWINGS

The invention, together with objects and advantages thereof, may best be understood by reference to the following description of the presently preferred embodiments together with the accompanying drawings in which:

FIG. 6A is a timing chart of an output terminal voltage;

FIG. 6B is a timing chart of an adjust signal;

FIG. 6C is a timing chart of a reference voltage;

FIG. 6D is a timing chart of a hold signal;

FIG. 7A is a timing chart of the output terminal voltage;

FIG. 7B is a timing chart of the adjust signal;

FIG. 7C is a timing chart of the reference voltage; and

FIG. 7D is a timing chart of the hold signal.

DETAILED DESCRIPTION OF THE PREFERRED EMBODIMENTS

The present invention provides a regulator circuit enabling efficient acquisition of the desired voltage.

One aspect of the present invention is a regulator circuit including a comparison means for comparing a reference voltage and a feedback voltage, which is generated from a target voltage input to an output terminal, and outputting a comparison result. An output means includes an output control element for controlling a drive voltage based on the comparison result and supplying the output terminal with an output voltage. The output means generates and outputs the feedback signal in accordance with the output of the control element. A counting means counts the feedback signal output from the output means and outputs a count signal. A latching means holds and outputs the count signal output from the counting means. A conversion means converts the counter signal output from the latching means to a reference voltage and supplies the reference voltage to the comparison means.

Other aspects and advantages of the present invention will become apparent from the following description, taken in conjunction with the accompanying drawings, illustrating by way of example the principles of the invention.

Figure 1:
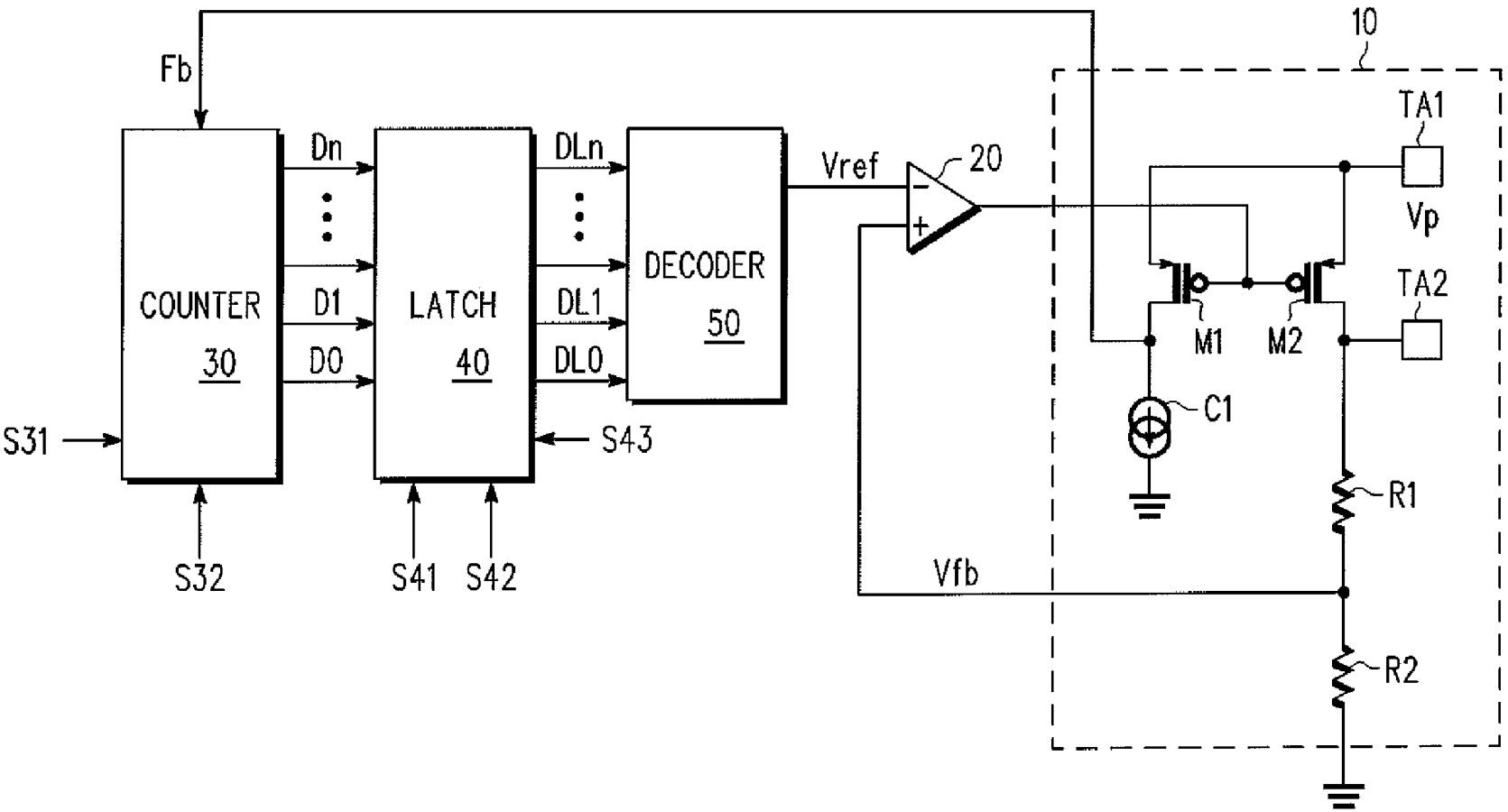
FIG. 1 is a schematic diagram showing the entire structure of a regulator circuit according to a preferred embodiment of the present invention.

A regulator circuit according to a preferred embodiment of the present invention will now be described with reference to FIGS. 1 to 7. As shown in FIG. 1, the regulator circuit of the preferred embodiment includes five circuit blocks. More specifically, the regulator circuit is provided with an output circuit 10 including a feedback loop, a comparator 20 serving as a comparison means, a counter block 30 serving as a counting means, a latch block 40 serving as a latching means, and a decoder block 50 serving as a conversion means.

The output circuit 10 functions as an output means and includes a voltage supply terminal TA1 and an output terminal TA2. Further, the output circuit 10 includes transistors M1 and M2, resistors R1 and R2, and a constant current source C1.

The transistor M1, which serves as a first transistor, and the transistor M2, which serves as a second transistor (output control element), are each formed by a P-channel MOS transistor. The transistors M1 and M2 each have a source terminal that is supplied with drive voltage from the voltage supply terminal TA1. The output terminal TA2 is arranged at a connection node between the transistor M2 and the resistor R1. Thus, the transistor M2 controls the voltage at the output terminal TA2.

The transistor M2 has a drain terminal that is connected to the resistor R1 and grounded via the resistors R1 and R2. The transistor M1 has a drain terminal that is connected to the constant current source C1 and grounded via the constant current source C1.

The transistors M1 and M2 have gate terminals that are connected to each other. Further, a connection node between these gate terminals is connected to an output terminal of the comparator 20.

A connection node between the resistors R1 and R2 is connected to a positive input terminal of the comparator 20.

The voltage at a connection node between the transistor M1 and the constant current source C1 is fed back as a feedback signal Fb to the counter block 30. The voltage at the output terminal TA2 is divided by the resistors R1 and R2 into a feedback voltage Vfb and supplied to the comparator 20.

A clock signal S31 and an adjust signal S32 are input to the counter block 30. The counter block 30 outputs count signals D0 to Dn.

The count signals D0 to Dn output from the counter block 30 are input to the latch block 40. A hold signal S41, a write signal S42, and a power ON reset inversion signal S43 are also input to the latch block 40. The latch block 40 outputs latch signals DL0 to DLn, which are generated from the count signals D0 to Dn.

The decoder block 50 outputs the reference voltage Vref based on the latch signals (DL0 to DLn) provided from the latch block 40. The reference voltage Vref is supplied to a negative input terminal of the comparator 20.

The comparator 20 compares the reference voltage Vref and the feedback voltage Vfb and outputs the result of the comparison.

Figure 2:
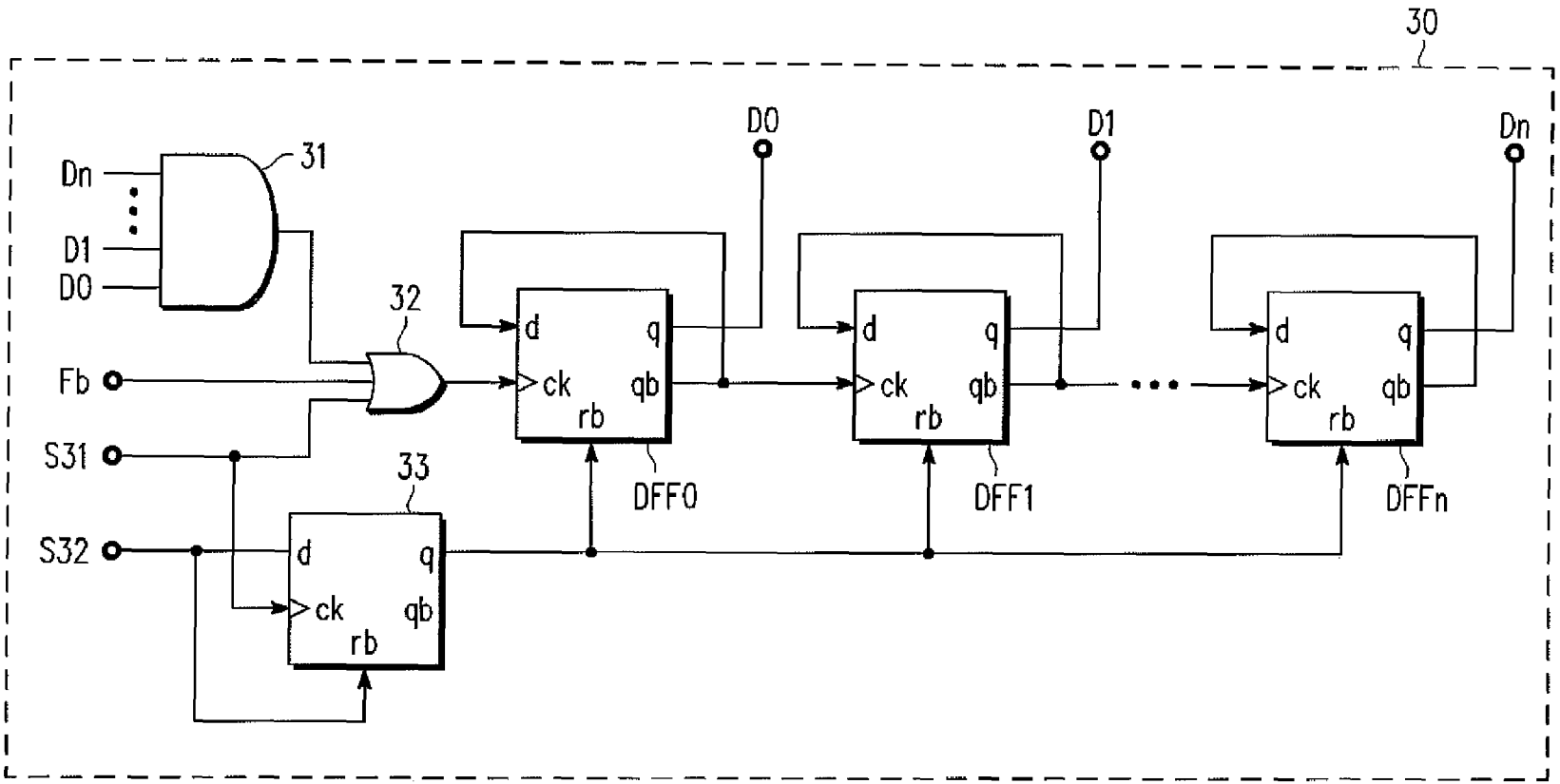
FIG. 2 is a schematic diagram of a counter block in the preferred embodiment.

An example of the structure of the counter block 30 will now be discussed with reference to FIG. 2.

The counter block 30 in the preferred embodiment includes an AND circuit 31, an OR circuit 32, and D-type flip-flops DFF0 to DFFn and 33.

The feedback signal Fb, the clock signal S31, and an output signal of the AND circuit 31 are input to the OR circuit 32. The AND circuit 31 receives count signals D0 to Dn, which are output from the counter block 30.

The output signal of the OR circuit 32 is input to the flip-flop DFF0. Each of the flip-flops DFF0 to DFFn has a d terminal that is supplied with its inverted output signal qb. Further, each of the flip-flops DFF1 to DFFn has a clock signal input terminal provided with the inverted output signal qb of the preceding flip-flop DFF0 to DFF(n−1). The flip-flops DFF0 to DFFn generate output signals q, which are output as the counter signals D0 to Dn of the counter block 30.

The flip-flop 33 has a clock signal input terminal provided with the clock signal S31. The flip-flop has a d input terminal and an inverted reset terminal provided with the adjust signal S32. The output signal q of the flip-flop 33 is provided to an inversion reset terminal of each of the flip-flops DFF1 to DFFn.

With this structure, when the adjust signal S32 shifts to a low level, the counter signals D0 to Dn are reset. A count value of the clock signal S31 that is input when the feedback signal Fb has a low level is expressed as a binary number and output as the counter signals D0 to Dn, which are provided to the latch block 40.

Figure 3:
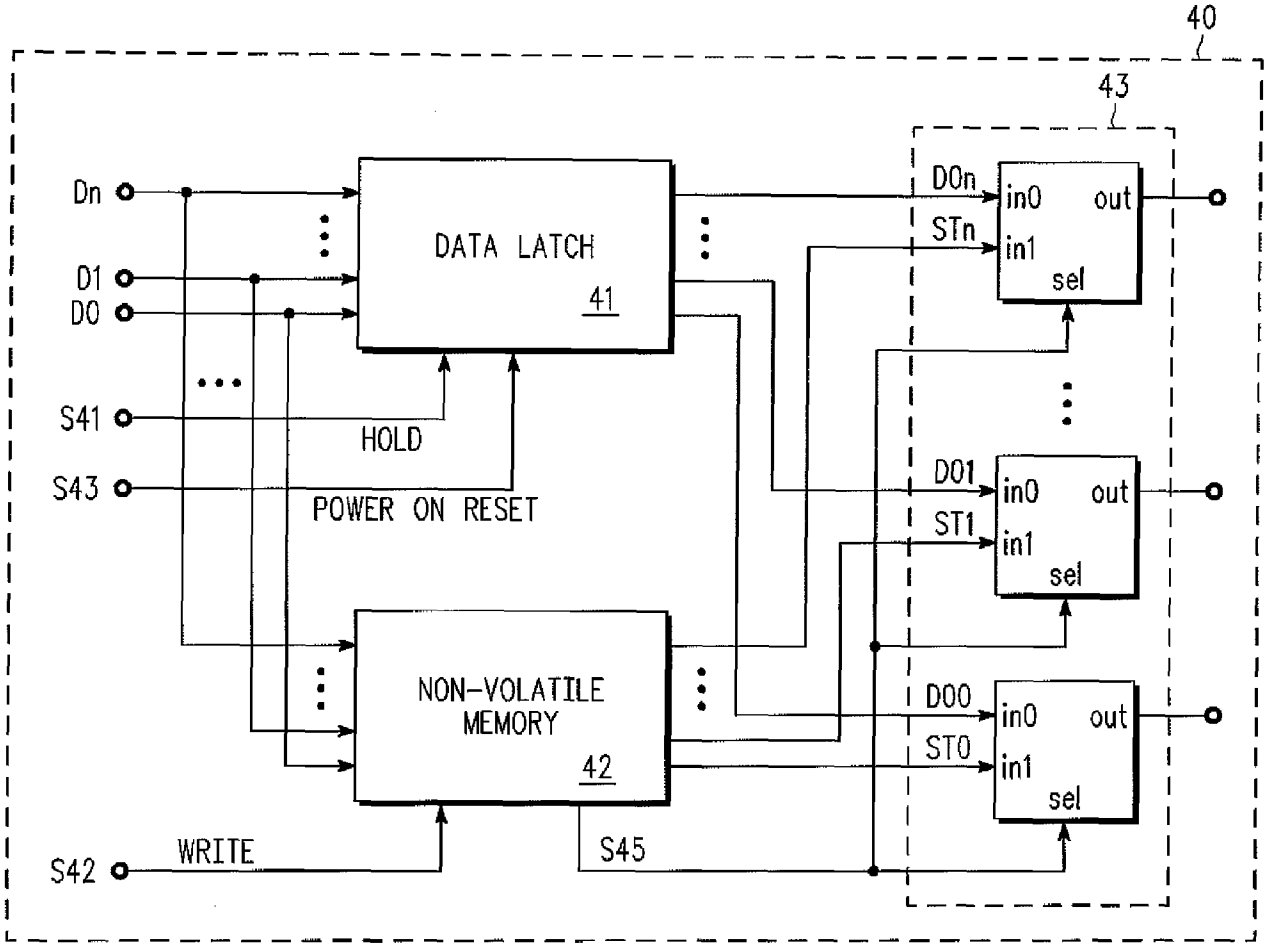
FIG. 3 is a schematic diagram of a latch block in the preferred embodiment.

An example of the structure of the latch block 40 will now be described with reference to FIG. 3.

In the preferred embodiment, the latch block 40 includes a data latch 41 serving as a signal holding means, a non-volatile memory 42 serving as a signal fixing means, and a multiplexer 43 serving as a selection means.

The counter signals D0 to Dn from the counter block 30 are input to the data latch 41 and the non-volatile memory 42.

The hold signal S41 and the power ON reset inversion signal S43 are input to the data latch 41.

Figure 4:
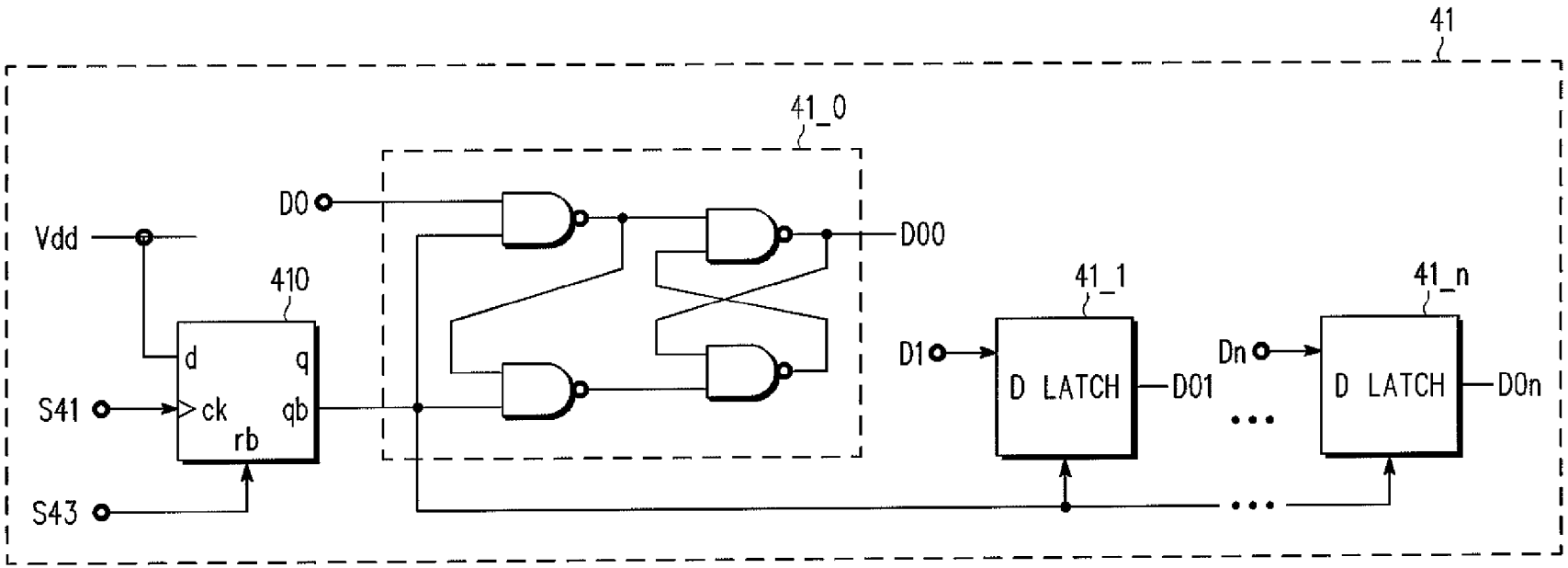
FIG. 4 is a schematic diagram of a data latch in the preferred embodiment.

As shown in FIG. 4, the data latch 41 includes D-type latch elements 41_0 to 41_n, which are respectively arranged in correspondence with the counter signals D0 to Dn, and a D-type flip-flop 410, which receives the power ON reset inversion signal S43.

The flip-flop 410 includes a d-input terminal supplied with drive voltage, a clock input terminal provided with the hold signal S41, and a reset inversion input terminal provided with the power ON reset inversion signal S43. The flip-flop 410 provides an inverted output signal qb to the gate terminal of each of the D-type latch elements 41_0 to 41_n. The D-type latch elements 41_0 to 41_n output signals DO0 to DOn in correspondence with the counter signals D0 to Dn, respectively.

The non-volatile memory 42 receives the write signal S42. The non-volatile memory 42 outputs a select signal S45 and signals ST0 to STn, which respectively correspond to the signals D0 to Dn. When the write signal S42 is input, the non-volatile memory 42 holds the present signal D0 to Dn and outputs the corresponding signal ST0 to STn. Further, once the write signal S42 is input, the select signal S45 is fixed at a high level.

The signals DO0 to DOn, which are output from the data latch 41, and the signals ST0 to STn and the select signal S45, which are output from the non-volatile memory 42, are input to the multiplexer 43.

Accordingly, when the write signal S42 has a low level, the latch block 40 outputs the counter signals D0 to Dn from the counter block 30 as the latch signals DL0 to DLn without performing any processing on the counter signals D0 to Dn.

When the hold signal S41 shifts to a high level, the present counter signal D0 to Dn is latched as the signal DO0 to DOn. The latching continues until data is cleared by the power ON reset inversion signal S43.

Once the write signal S42 shifts to a high level, the non-volatile memory 42 writes and permanently holds the present counter signal D0 to Dn. In this case, the select signal S45 also shifts to a high level. Then, the written counter signal D0 to Dn is output as the signal ST0 to STn regardless of the power state.

The multiplexer 43 of the latch block 40 includes multiplexer elements, each having input terminals in0, in1, and se1. Based on the select signal S45, the multiplexer elements select either the signals DO0 to DOn or the signals ST0 to STn and output the selected signals as the latch signals DL0 to DLn, respectively. The select signal S45 initially has a low level. In this case, the signals DO0 to DOn are selected and output as the latch signals DL0 to DLn. When the select signal S45 has a high level, the multiplexer elements select the signals ST0 to STn, which are output as the latch signals DL0 to DLn. The latch signals DL0 to DLn are provided to the decoder block 50.

Figure 5:
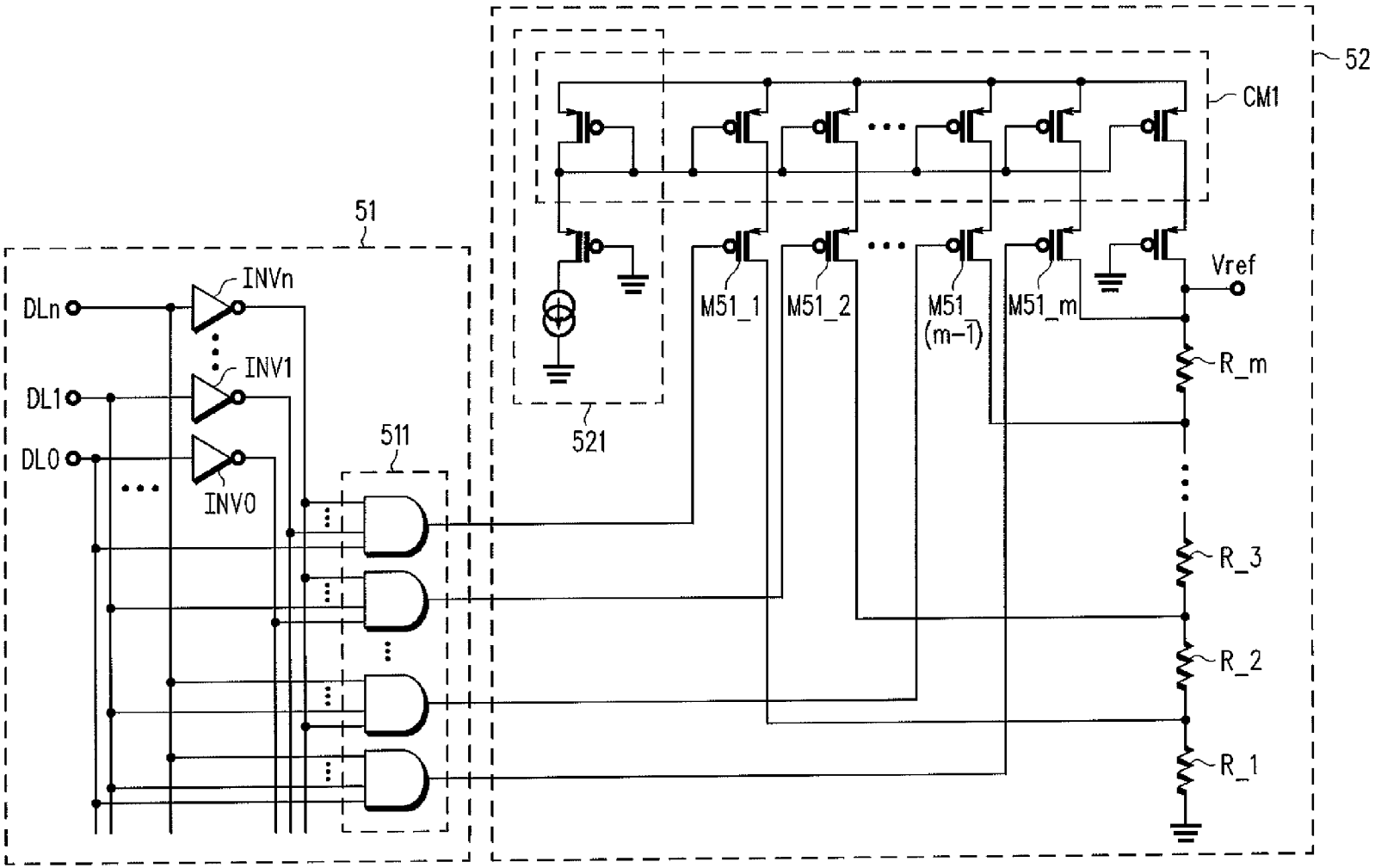
FIG. 5 is a schematic diagram of a decoder block in the preferred embodiment.

An example of the structure of the decoder block 50 will now be described with reference to FIG. 5.

The decoder block 50 includes a decoder circuit 51, which converts the latch signals DL0 to DLn to analog signals, and a reference voltage output circuit 52. The decoder circuit 51 includes inverters INV0 to INVn respectively inverting the latch signals DL0 to DLn.

Further, the decoder circuit 51 includes a conversion means 511, which is formed by an m number of AND circuits, where m expresses (2 raised to the power of n)−1. For the latch signals DL0 to DLn, AND circuits are provided for each and every one of the combinations of the signals and inverted signals.

In the conversion means, when the input latch signals DL0 to DLn and their inverted signals are input to the corresponding AND circuits in a combination in which each signal has a high level, those AND circuits generate an output with a low level and the other AND circuits generate an output with a high level.

The reference voltage output circuit 52 includes a bias circuit 521 and a corresponding current mirror circuit CM1. The current mirror circuit CM1 supplies each of connected transistors M51_1 to M51_m with the same current. The transistors M51 are labeled with 1 to m from the uppermost stage.

The transistors M51_1 to M51_m are formed by P-channel MOS transistors. The transistors M51_1 to M51_m each have a drain terminal connected to connection nodes of an m number of series-connected resistors R_1 to R_m.

Further, the transistors M51_1 to M51_m each have a gate terminal connected to an AND circuit of the conversion means 511. The connected AND circuit is of the order corresponding to "1 to m", which is obtained by converting the binary notation of the latch signals DL0 to DLn into a decimal notation.

As a result, in the conversion means 511, the AND circuits corresponding to the latch signals DL0 to DLn shift to a low level, and the transistor provided with the output signal of the AND circuit is activated so as to output current. The current is converted into the reference voltage Vref by the resistors R_1 to R_m and output to the comparator 20.

The operation of the regulator circuit will now be described. First, the desired target voltage is applied to the output terminals TA2. In this case, the feedback voltage Vfb is supplied to the comparator 20. The reference voltage Vref initially takes a minimum value. Thus, the comparator 20 generates an output having a high level. In this case, the transistors M1 and M2 are inactivated. Thus, the feedback signal Fb provided to the counter block 30 has a low level.

The reference voltage Vref gradually increases as long as the counter block 30 is performing counting. As the voltage applied to the output terminal TA2 reaches the target voltage and the reference voltage Vref exceeds the feedback voltage Vfb, the comparator 20 activates the transistors (M1 and M2). In this case, the feedback signal shifts to a high level.

When the feedback signal Fb shifts to a high level, the counter block 30 stops the clock signal. When each of the signals D0 to Dn shift to a high level, the counter block 30 also blocks the clock signal.

In this case, the counter block 30 holds the signals D0 to Dn at the point of time in which the reference voltage Vref exceeds the feedback voltage Vfb. The reference voltage Vref is used so that the output voltage is adjusted to be equal to the target voltage.

When the target voltage is applied to the output terminal TA2 in a stepped manner as shown in FIG. 6A, during the period in which the adjust signal S32 is provided as shown in FIG. 6B, the reference voltage Vref increases in a stepped manner and stops increasing when reaching the feedback voltage Vfb as shown in FIG. 6C. In this case, the hold signal S41 is not provided as shown in FIG. 6D. Thus, when the adjust signal S32 is stopped, the reference voltage Vref is increased again from the beginning.

When the target voltage is applied to the output terminal TA2 in a stepped manner as shown in FIG. 7A and the adjust signal S32 is provided as shown in FIG. 7B, the reference voltage Vref increases in a stepped manner as shown in FIG. 7C. When the hold signal S41 is provided at time t1 as shown in FIG. 7D, the reference voltage Vref stops rising. Further, when the application of the target voltage to the output terminal TA2 is stopped at time t2, the voltage at time t1 is output.

The regulator circuit of the preferred embodiment has the advantages described below.

In the preferred embodiment, the regulator circuit includes the output circuit 10, the comparator 20, the counter block 30, the latch block 40, and the decoder block 50. When the desired target voltage is applied to the output terminal TA2 of the output circuit 10, the feedback signal Fb is generated based on the output of the comparator 20. The counter block 30 performs counting with the clock signal based on the feedback signal Fb. The latch block 40 holds the signal, and the decoder block 50 performs conversion to an analog reference voltage Vref. The comparator 20 compares the reference voltage Vref with the feedback voltage Vfb, which is generated from the target voltage applied to the output terminal TA2. When the reference voltage Vref and the feedback voltage Vfb become equal to each other, the feedback signal is switched to stop the counting that is performed by the counter block 30. Accordingly, by applying and setting the target voltage to the output terminal TA2, which outputs the desired voltage, there is no difference in the feedback state between the adjustment stage and normal operation stage. Thus, accurate setting can be performed. That is, the offset voltage of the comparator and errors such as those caused by resistor division are compensated for. Further, there is need only to apply the target voltage to the output terminal. Thus, the setting for outputting the target voltage is performed through a simple task.

In the preferred embodiment, the latch block 40 of the regulator circuit includes the data latch 41. When the hold signal S41 is input, the data latch 41 holds the setting for outputting the target voltage. This enables continuous output of the target voltage. Further, when the power ON rest inversion signal S43 is input, the data held by the data latch 41 is cleared. Thus, the target voltage may be changed when necessary. This facilitates operation evaluations and debugging.

In the preferred embodiment, the latch block 40 of the regulator circuit includes a non-volatile memory 42 and a multiplexer 43. When the write signal S42 is input, the non-volatile memory 42 holds and outputs the present signal D0 to Dn as the signal St to Stn. Once the write signal S42 is input, the select signal S45 is fixed at a high level. When the select signal S45 has a high level, the multiplexer 43 selects and outputs the signals ST0 to STn as the latch signals DL0 to DLn. The latch signals DL0 to DLn are provided to the decoder block 50. This enables a setting so that the target voltage is output in a permanent manner. Thus, the regulator circuit may be used for mass-production.

It should be apparent to those skilled in the art that the present invention may be embodied in many other specific forms without departing from the spirit or scope of the invention. Particularly, it should be understood that the present invention may be embodied in the following forms.

In the preferred embodiment, the non-volatile memory 42 is used as the signal fixing means. However, the present invention is not limited in such a manner. For example, a fuse trimming circuit may be used as the signal fixing means.

In the preferred embodiment, the counter block 30 is formed by D-type flip-flops. However, the present invention is not limited in such a manner. Any device may be used to form the counter block 30 as long as it functions to perform counting in accordance with the output of the comparator 20.

In the preferred embodiment, the data latch 41 is formed by D-type latch elements. However, the present invention is not limited in such a manner, and any device that enables the holding of a signal may be used to form the data latch 41.

Further, in the preferred embodiment, the reference voltage output circuit 52 is formed by the bias circuit 521 and the corresponding current mirror circuit CM1. However, the present invention is not limited in such a manner. Any device enabling the voltage to be changed in accordance with the input may be used to form the reference voltage output circuit 52.

In the preferred embodiment, P-channel MOS transistors are used. However, the present invention is not limited in such a manner. Other conductive elements such as N-channel MOS transistors may also be used.

In the preferred embodiment, data is latched based on the hold signal S41 input from an external device. Instead a count detection means may be used to output the hold signal S41 upon detection of a counting suspension. This enables automatic holding to be performed when reaching the desired voltage.

The present examples and embodiments are to be considered as illustrative and not restrictive, and the invention is not to be limited to the details given herein, but may be modified within the scope and equivalence of the appended claims.

What is claimed is:

1. A regulator circuit comprising:

a comparison means for comparing a reference voltage and a feedback voltage, which is generated from a target voltage input to an output terminal, and outputting a comparison result;

an output means including an output control element for controlling a drive voltage based on the comparison result and supplying the output terminal with an output voltage, wherein the output means generates and outputs the feedback signal in accordance with the output of the control element;

a counting means for counting the feedback signal output from the output means and outputting a count signal;

a latching means for holding and outputting the count signal output from the counting means; and a conversion means for converting the counter signal output from the latching means to a reference voltage and supplying the reference voltage to the comparison means.

2. The regulator circuit according to claim 1, wherein the output means includes:

a first transistor and a second transistor of which source terminals are supplied with the drive voltage;

a constant current source connected to a drain terminal of the first transistor, wherein the feedback signal is generated at a connection node between the drain terminal and the constant current source;

the output terminal arranged at the drain terminal of the second transistor that serves as the output control element; and a resistor connected to the drain terminal of the second transistor for generating the feedback voltage.

3. The regulator circuit according to claim 1, wherein the latching means includes a signal holding means for acquiring a hold signal and temporarily holding the count signal output from the counting means based on the hold signal.

4. The regulator circuit according to claim 1, wherein the latching means includes a signal fixing means for acquiring a write signal and permanently storing the count signal output from the counting means based on the write signal.

5. The regulator circuit according to claim 1, wherein the latching means acquires a hold signal or a write signal and includes:

a signal holding means for temporarily holding the count signal output from the counting means based on the hold signal;

a signal fixing means for permanently storing the count signal output from the counting means based on the write signal; and a selection means for selectively outputting one of an output signal of the signal holding means and an output signal of the signal fixing means.

6. A regulator circuit, comprising:

a comparator for comparing a reference voltage and a feedback voltage, wherein the feedback voltage is generated from a target voltage at an output terminal, and outputting a comparison result;

an output circuit including an output control element for controlling a drive voltage based on the comparison result and supplying the output terminal with an output voltage, wherein the output circuit generates and outputs the feedback voltage in accordance with the output voltage output by the output control element;

a counter, connected to the output circuit, for counting a feedback voltage signal and generating a count signal;

a latch, connected to the counter, for holding and outputting the count signal; and a decoder connected to the latch for converting the counter signal output by the latch to the reference voltage and supplying the reference voltage to the comparator.

7. The regulator circuit of claim 6, wherein the output circuit further comprises:

first and second transistors having source terminals that are supplied with the drive voltage;

a constant current source connected to a drain terminal of the first transistor, wherein the feedback signal is generated at a connection node between the drain terminal of the first transistor and the constant current source;

wherein the output terminal is arranged at the drain terminal of the second transistor, which serves as the output control element; and a resistor connected to the drain terminal of the second transistor for generating the feedback voltage.

8. The regulator circuit of claim 6, wherein the latch includes a signal holding circuit for acquiring a hold signal and temporarily holding the count signal output by the counter based on the hold signal.

9. The regulator circuit of claim 6, wherein the latch includes a signal fixing circuit for acquiring a write signal and storing the count signal output from the counter based on the write signal.

10. The regulator circuit of claim 6, wherein the latch acquires one of a hold signal and a write signal, the latch further comprising:

a signal holding circuit for temporarily holding the count signal output by the counter based on the hold signal;

a signal fixing circuit for storing the count signal based on the write signal; and a selector for selectively outputting one of an output signal of the signal holding circuit and an output signal of the signal fixing circuit.

11. A regulator circuit, comprising:

a comparator for comparing a reference voltage and a feedback voltage, and outputting a comparison result;

an output circuit for controlling a drive voltage based on the comparison result and supplying an output terminal with an output voltage, wherein the output circuit generates and outputs the feedback voltage and a feedback voltage signal in accordance with the output voltage;

a counter, connected to the output circuit, for counting the feedback voltage signal and generating a count signal;

a latch, connected to the counter, for holding and outputting the count signal; and a decoder connected to the latch for converting the counter signal output by the latch to the reference voltage and supplying the reference voltage to the comparator, wherein the output circuit comprises:

first and second transistors having source terminals supplied with the drive voltage, and gate terminals connected comparator and receiving the comparison result;

a constant current source connected to a drain terminal of the first transistor, where the feedback voltage is generated at a node between the constant current source and the drain terminal of the first transistor; and a first and second resistors connected in series between the drain terminal of the second transistor and ground, wherein the feedback voltage is generated at a node between the first and second resistors.

* * * * *